United States Patent [19]

Snodgrass

[11] 4,073,397

[45] Feb. 14, 1978

[54] FOWL-SHAPED CONTAINER

[76] Inventor: Elvin E. Snodgrass, Rte. 2, Wappapello, Mo. 63966

[21] Appl. No.: 700,586

[22] Filed: June 28, 1976

[51] Int. Cl.[2] ..... B65D 1/02

[52] U.S. Cl. ..... 215/1 C; D9/35; 43/3; 46/11; 215/100 A; 222/78

[58] Field of Search ..... 43/3; D9/10, 11, 16, D9/32, 35, 36, 13, 199; 222/78; 215/1 R, 1 C, 100 A; 46/11

[56] References Cited

U.S. PATENT DOCUMENTS

| | | | |
|---|---|---|---|
| D. 6,159 | 10/1872 | Dawes | D9/32 |
| D. 205,480 | 8/1966 | Thomte | D9/35 |
| D. 210,866 | 4/1968 | Wickham | D9/32 |
| 2,518,721 | 8/1950 | Risch | 43/3 |
| 2,885,813 | 5/1959 | Kratzert | 43/3 |
| 3,800,457 | 4/1974 | Barrett | 43/3 |

FOREIGN PATENT DOCUMENTS

| | | | |
|---|---|---|---|
| 775,308 | 1/1968 | Canada | 43/3 |

*Primary Examiner*—Donald F. Norton
*Attorney, Agent, or Firm*—Gravely, Lieder & Woodruff

[57] ABSTRACT

A container possesses the configuration of a duck so that once it is emptied of its contents it may be used as a duck decoy, or as a toy, or for some other purpose which requires a duck-shaped appearance.

7 Claims, 7 Drawing Figures

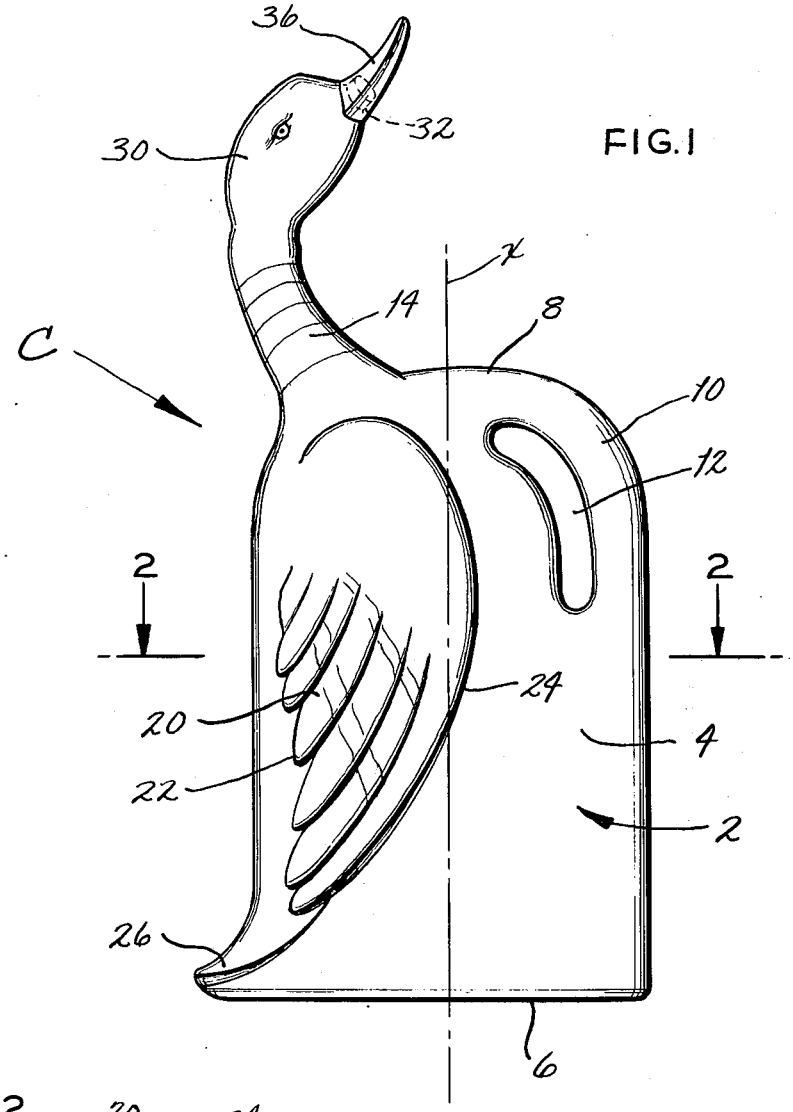
FIG. 1
FIG. 2
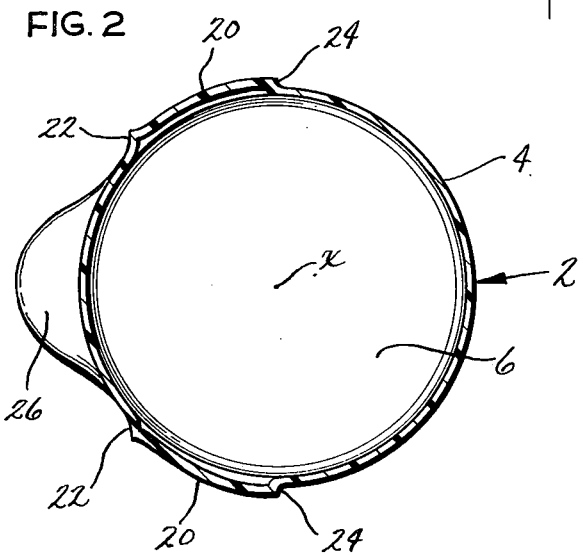
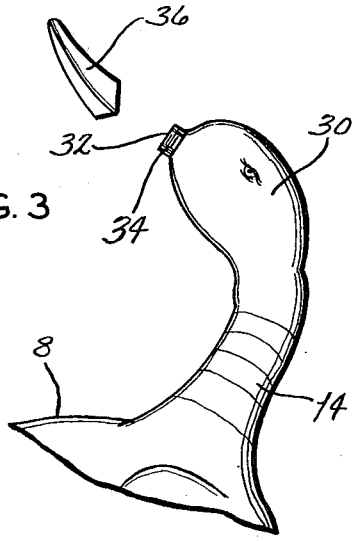
FIG. 3

FIG. 4
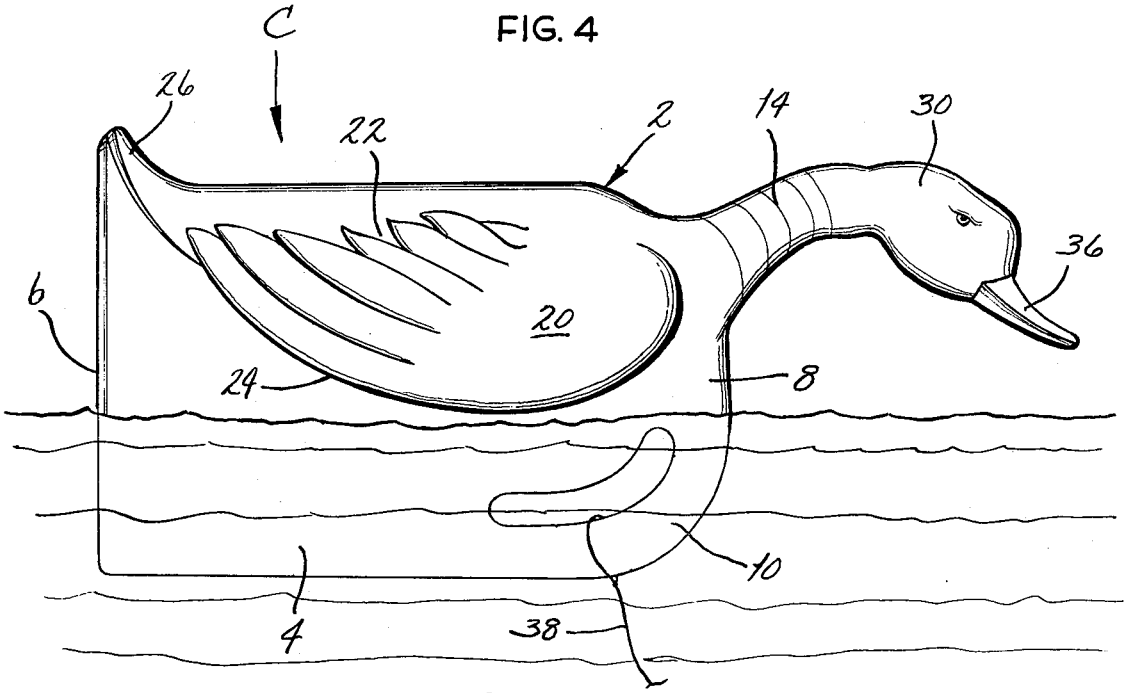
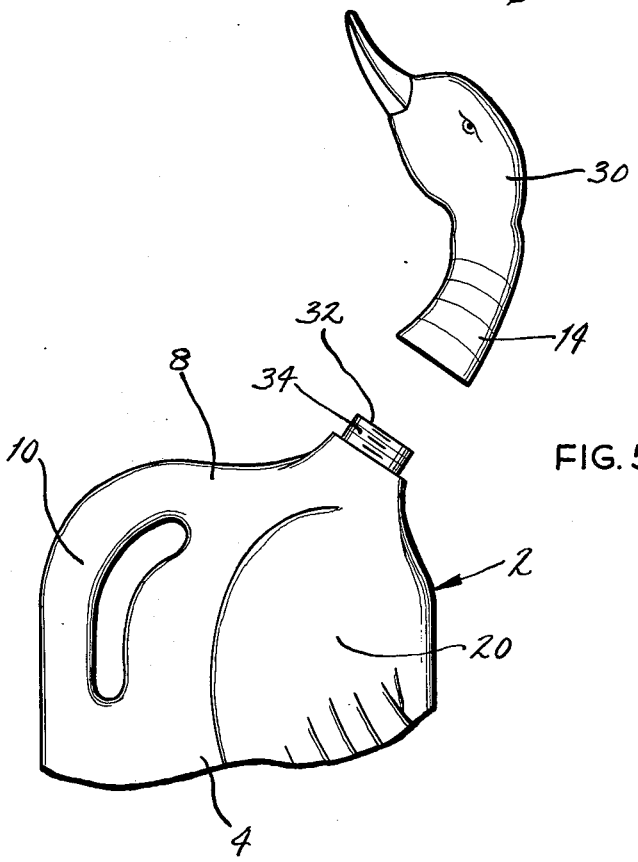
FIG. 5

FOWL-SHAPED CONTAINER

BACKGROUND OF THE INVENTION

This invention relates in general to containers and, more particularly, to a container having the appearance of a fowl.

Containers for liquid products as diversified as milk and laundry bleach take many shapes, but irrespective of the shape, the containers are suitable for just one purpose, namely holding the liquid product. In most instances little if any thought is given to subsequent uses of the containers. Indeed, most containers for liquid products are merely disposed of once they are emptied of their liquid contents. Many containers of current manufacture are blow-molded from a suitable plastic.

SUMMARY OF THE INVENTION

One of the principal objects of the present invention is to provide a container which possesses the external configuration of a duck or other species of fowl. Another object is to provide a container of the type stated which may be utilized as a duck decoy or a child's toy. A further object is to provide a container of the type stated which is ideally suited for holding a variety of household products such as milk and laundry bleach and may be provided in the conventional gallon or any other size. An additional object is to provide a container of the type stated using conventional blow-molding techniques. These and other objects and advantages will become apparent hereinafter.

The present invention is embodied in a container which has a body shaped to resemble that of a duck or other fowl. A spout is connected with the body for providing access to the interior thereof. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a side elevational view of a fowl-shaped container constructed in accordance with and embodying the present invention;

FIG. 2 is a sectional view taken along line 2—2 of FIG. 1;

FIG. 3 is a fragmentary elevational view showing the head of the fowl-shaped container with the spout of the container being in the head area and the cap being in the form of a beak;

FIG. 4 is a side elevational view showing the container used as a duck decoy;

FIG. 5 is a fragmentary elevational view of a modified container having the spout at the base of the neck;

DETAILED DESCRIPTION

Figure 7:
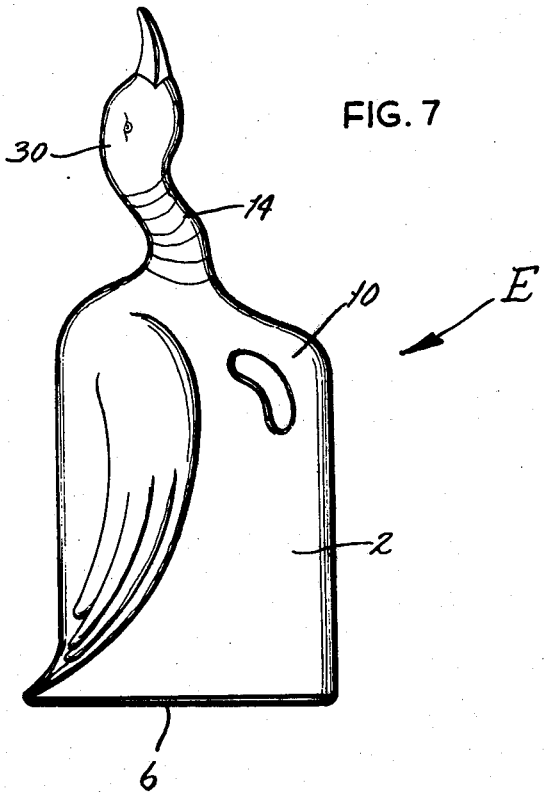
FIG. 7 is a side elevational view of still another modified container.
Figure 6:
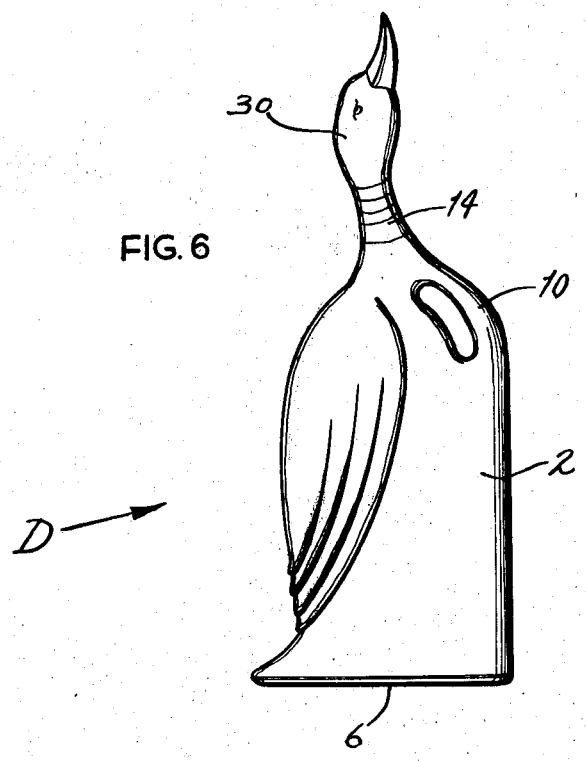
FIG. 6 is a side elevational view of another modified container.

Referring now to the drawings (FIG. 1), C designates a container which in appearance resembles a duck with its wings folded as they would be if the duck were floating on water. Actually, when the container C is used for the purpose of holding liquids, the duck it resembles appears to be standing on its tail feathers which is not a natural position. However, when the container is turned on its side, the duck it resembles will appear natural, that is it will have the shape of quite similar to the shape of a duck floating on water. Hence, the container has two positions, namely the liquid containing position and the duck-simulative position. Terms of orientation will be used in conjunction with both positions and should be clear from the context in which they are used. For example, the bottom wall of the container is actually the tail of the duck.

The container C includes (FIG. 1) a hollow body 2 which is made from a material impervious to fluids and resembles the body of a duck with its wings folded. The body 2 includes a curved side wall 4 which at its one end merges into a flat bottom wall 6 and at its opposite end merges into a curved and somewhat dome-shaped top wall 8. The bottom wall 6 is generally squared off with respect to the side wall 4 so that when the container C rests on the bottom wall 6, the side wall 4 is upright. The side wall 4, which is generally circular in cross-section (FIG. 2), corresponds to the back and underside of the duck, while the bottom wall 6 is the tail of the duck. The domeshaped top wall 8 is for the most part the breast of the duck, and that wall has a handle 10 molded into it adjacent the underside of the duck. The handle 10 forms an elongated void or slot 12 in the body 2. At the top wall 8 a hollow neck 14 projects from the body 2 somewhat obliquely to the longitudinal axis X.

The side wall 4 of the body 2 has two wings 20 embossed into it, and these wings are delineated by an irregular upper margin 22 and a curved lower margin 24. The irregular upper margin 22 possesses a saw tooth configuration and is located generally along the back of the duck. It merges at both ends into the curved lower margins 24 which extends along the front and bottom of the wing 20. The lower margin 24 does not extend much below the longitudinal axis X of the body 2. At the bottom wall 6 the body 2 has a tail 26 which flares outwardly, or with respect to the duck configuration it flares upwardly somewhat above the back. The tail 26 forms a rearward and upward continuation of the lower margins 24 for the wings 20. The back of the tail 26 is, of course, the bottom wall 6 of the body 2. Thus, the tail 26 constitutes an outwardly swept section on the side and bottom walls 4 and 6.

The hollow neck 14 projects from the top wall 8 slightly ahead of the front part of the curved lower margins 24 for the wings 20. It merges into an enlarged head 30 which resembles the head of a duck. The head 30 in turn merges into a spout 32 (FIG. 3) which is located in the vicinity normally occupied by the beak of the duck. The spout 32 has external threads 34 over which a cap 36 is threaded, and the cap 36 possesses the configuration of a duck beak. Hence, the head 30, when the cap 36 is threaded over the spout 32, resembles the head of a duck. The neck 14, the head 30, the spout 32, and the cap 36 all constitute an end section which projects away from the top wall of the body 2.

The body 2 may be formed from any of the many impervious materials from which conventional containers are usually made. Particularly suitable is polyethylene plastic which may be shaped into the configuration of the body 2 in a blow molding process as are conventional plastic milk containers. The beak-shaped cap 36 may be molded from a suitable plastic. Both the body 2 and cap 36 should have coloring resembling a natural duck. The body 2 will normally be various shades of brown, while the neck 14 and head 30 may be a deep green, with a white ring at the base of the neck.

OPERATION

In use, the body 2 is filled with the liquid to be sold in it. The cap 36 is then threaded over the spout 32 to seal the liquid contents within the body 2. The container C is shipped and stored with the bottom wall 6 resting on a supporting surface such as a box bottom or a shelf (FIG. 1). In that condition the side wall 4 is upright and the handle 10 is presented upwardly where it may be easily grasped. The neck 14 and head 30 project upwardly, making the cap 36 easily accessible.

To pour the contents from the container C, the cap 36 is removed (FIG. 3) and the body 2 is grasped at its handle 10 and tilted until the liquid contents issue from spout 32. When sufficient content have been poured, the body 2 is again set down on its bottom wall 6 and the cap 36 is threaded back over the spout 32 on the head 30.

Once the container C is emptied of its contents, it may be used as duck decoy or child's toy. In either case, the cap is threaded back onto the spout so that its interior is sealed. Moreover, the container C is now turned so that it is supported on the portion of its side wall 4 which forms the bottom or underside of the duck. As a result the tail 26 projects upwardly, while the neck 14 and head 30 project forwardly and slightly upwardly. The wings 20 are located at the sides C and the handle 10 is presented downwardly where it is least visible.

When used as a duck decoy the emptied container C floats on that portion of the side wall 4 which forms the underside of the duck (FIG. 4). A slight amount of ballast may be added to the container C to keep the head 30 and tail 26 uppermost. The ballast may take the form of sand spread over that portion of the side wall 4 which forms the underside of the duck. An anchor line 38 may be tied to the handle 10 to keep the container C from drifting.

MODIFICATIONS

In lieu of forming the spout 32 at the beak of the head 30, the spout may be formed in the neck 14 (FIG. 5). In this embodiment, the neck 14 has external threads located slightly beyond the body 2 and mating internal threads so that the neck is separable intermediate its ends. In effect, the upper portion of the neck 14 and head 30 with the beak formed integrally with it constitutes the cap. Again the neck 14 and head 30 constitute an end section.

The cap need not necessarily be secured with screw threads, for any suitable securing arrangement may be utilized. For example, it may snap in place over a rim, or it may have a plug which fits into the interior of the spout 32 and is held in place by friction, much the same as a cork on a wine bottle.

A modified container D is quite similar to the container C, but the body 2 is somewhat thinner and the neck 14 is straight and generally centered with respect to the body 2.

Another modified container E contains similar variations, yet is slightly different in configuration.

This invention is intended to cover all changes and modifications of the example of the invention herein chosen for purposes of the disclosure which do not constitute departures from the spirit and scope of the invention.

What is claimed is:

1. A container comprising: a generally tubular body having a longitudinal axis and being shaped to generally resemble the body of a duck or similar fowl, the body including a tubular side wall of generally circular configuration that is generally concentric about the longitudinal axis and the sidewall having embossments on opposite sides of it, with the embossments being in the shape of folded wings, the body also including a bottom wall connected to the sidewall and being generally flat and generally squared off with respect to the side wall so that when the container rests on the bottom wall, the side wall will be in a generally upright position, the bottom wall and the lower end of the side wall being swept outwardly intermediate the rear ends of the folded wings to form an outwardly projected section having the shape of tail feathers, the outwardly projected section having a curved outer margin where the side and bottom walls are connected, the body further including a curved top wall connected to the other end of the tubular side wall, the top wall having a slot therein to provide a handle at which the container may be grasped, with the slot being located in the breast area of the duck-shaped body; and a reduced end section extended generally upwardly from the top wall of the body and being offset from the longitudinal axis and away from and opposed to the handle in the breast area of the duck-shaped body so as to be located intermediate the forward ends of the folded wings, the end section including a neck portion which is connected at its one end to the top wall of the body and a head portion which is connected to the other end of the neck portion, the neck portion resembling the neck of a duck and being extended in generally the same direction as the longitudinal axis so as to project upwardly beyond the end of the side wall and within the circumference of the side wall, the head portion resembling the head of a duck, the end section being separable into a spout and a cap with the spout being hollow and opening into the hollow interior of the body, whereby when the cap is removed from the spout, the relative positions of the handle and the spout facilitate the pouring of liquid contents from the container.

2. A container according to claim 1 wherein the container is generally circular in cross section.

3. A container according to claim 1 wherein the side wall is symmetrical about the longitudinal axis.

4. A container according to claim 1 wherein the end section is separable at its lower end adjacent to the top wall of the body.

5. A container according to claim 1 wherein the head portion has a beak and the end section is separable at the base of the beak.

6. A container according to claim 1 wherein at the breast area of the duck configuration the top wall merges into the side wall along a gentle curve, and the slot in the body is curved and generally follows the contour of the gentle curve.

7. A container according to claim 6 wherein the neck portion is offset from the same side of the center axis as the wings.

* * * * *